US008123141B2

(12) United States Patent
Lacey

(10) Patent No.: US 8,123,141 B2
(45) Date of Patent: Feb. 28, 2012

(54) LAUNDRY TRANSPORT APPARATUS

(76) Inventor: Bertram E. Lacey, Frederick, MD (US)

( * ) Notice: Subject to any disclaimer, the term of this patent is extended or adjusted under 35 U.S.C. 154(b) by 424 days.

(21) Appl. No.: 12/357,459

(22) Filed: Jan. 22, 2009

(65) Prior Publication Data

US 2010/0180461 A1 Jul. 22, 2010

(51) Int. Cl.
*F24F 3/14* (2006.01)
*F24F 7/08* (2006.01)

(52) U.S. Cl. ..... 236/44 C; 236/49.3; 454/239; 34/218

(58) Field of Classification Search ..... 236/44 A, 236/44 C, 49.3; 454/239, 252; 34/218
See application file for complete search history.

(56) References Cited

U.S. PATENT DOCUMENTS 3,249,294 A 5/1966 Hughes et al.
3,318,722 A 5/1967 Ullman
3,656,542 A * 4/1972 Darm ..... 165/66
5,337,581 A 8/1994 Lott
7,000,798 B2 2/2006 Gruennert
7,310,969 B2 * 12/2007 Dale ..... 62/407

* cited by examiner

*Primary Examiner* — Marc Norman
(74) *Attorney, Agent, or Firm* — Dale J. Ream

(57) ABSTRACT

A laundry transport apparatus and method includes a container defining an interior area configured to accommodate a plurality of laundry carts, the container having a door movable between closed and open configurations to selectively allow access to said interior area. The container is a trailer configured to be moved by a vehicle. The apparatus includes a ventilation network to pass air to and from the interior area, the ventilation network including an intake duct for channeling air to the interior area and an outlet duct for channeling air from the interior area. At least a portion of the intake and outlet ducts are immediately adjacent one another to influence temperature of air passing through each duct, warmer air passing through one of the intake duct or the outlet duct becoming cooler and cooler air passing through another of the intake duct or the outlet duct becoming warmer.

5 Claims, 5 Drawing Sheets

LAUNDRY TRANSPORT APPARATUS

BACKGROUND OF THE INVENTION

This invention relates generally to laundry systems and, more particularly, to a method and apparatus for transporting laundry that increases the efficiency and lowers the cost of laundering textiles.

Linens are typically collected from commercial users during normal working hours from multiple workstations, such as from hospitals, nursing facilities, or industrial facilities. The soiled linens are usually placed into linen carts that remain in predetermined locations throughout the facility. The linen carts are retrieved upon arrival of the laundry truck from a laundry processing facility and weighted prior to loading onto the truck. This process is very inefficient and may lead to delays for both the cleaning staff and the launderers. Another problem frequently experienced in laundry processing is that linens may not be properly stored and thus may become degraded by environmental factors such as ultraviolet light, moisture, temperature, insects, and textile mold and mildew.

Various devices have been proposed in the art for transporting and laundering textiles. Although assumably effective for their intended purposes, the existing devices and methods are either inefficient, not cost effective, or fail to optimize the sanitation and freshness characteristics of the textiles being transported and laundered.

Therefore, it would be desirable to have an apparatus and method for transporting and laundering textiles that is efficient and cos 7-8t-effective. Further, it would be desirable to have an apparatus and method for transporting and laundering textiles that provides a transportation apparatus that avoids degradation of stored linens from environmental factors. In addition, it would be desirable to have an apparatus and method for transporting and laundering textiles that provides security and insect control.

SUMMARY OF THE INVENTION

Therefore, a laundry transport apparatus and method according to the present invention includes a container defining an interior area configured to accommodate a plurality of laundry carts, the container having a door movable between closed and open configurations to selectively allow access to said interior area. The container is a trailer configured to be moved by a vehicle. The apparatus includes a ventilation network to pass air to and from the interior area, the ventilation network including an intake duct for channeling air to the interior area and an outlet duct for channeling air from the interior area. At least a portion of the intake and outlet ducts are immediately adjacent one another to influence temperature of air passing through each duct, warmer air passing through one of the intake duct or the outlet duct becoming cooler and cooler air passing through another of the intake duct or the outlet duct becoming warmer.

Therefore, a general object of this invention is to provide an apparatus and method for transporting and storing laundry that avoids degradation of linens by environmental conditions.

Another object of this invention is to provide an apparatus and method, as aforesaid, having a container that is climate controlled.

Still another object of this invention is to provide an apparatus and method, as aforesaid, that increases the efficiency and cost-effectiveness of laundry transportation and storage services.

Yet another object of this invention is to provide an apparatus and method, as aforesaid, in which the laundry transport container is a truck trailer that is movable between pickup, processing, and receiving facilities.

A further object of this invention is to provide an apparatus and method, as aforesaid, in which the transport trailer maintains an internal air environment that is controlled by a processor and may be remotely monitored.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A laundry transport apparatus and a method of transporting laundry will now be described in detail with reference to FIG. 1*a* through FIG. 5 of the accompanying drawings. More particularly, a laundry transport apparatus 100 includes a container 110.

Figure 1A:
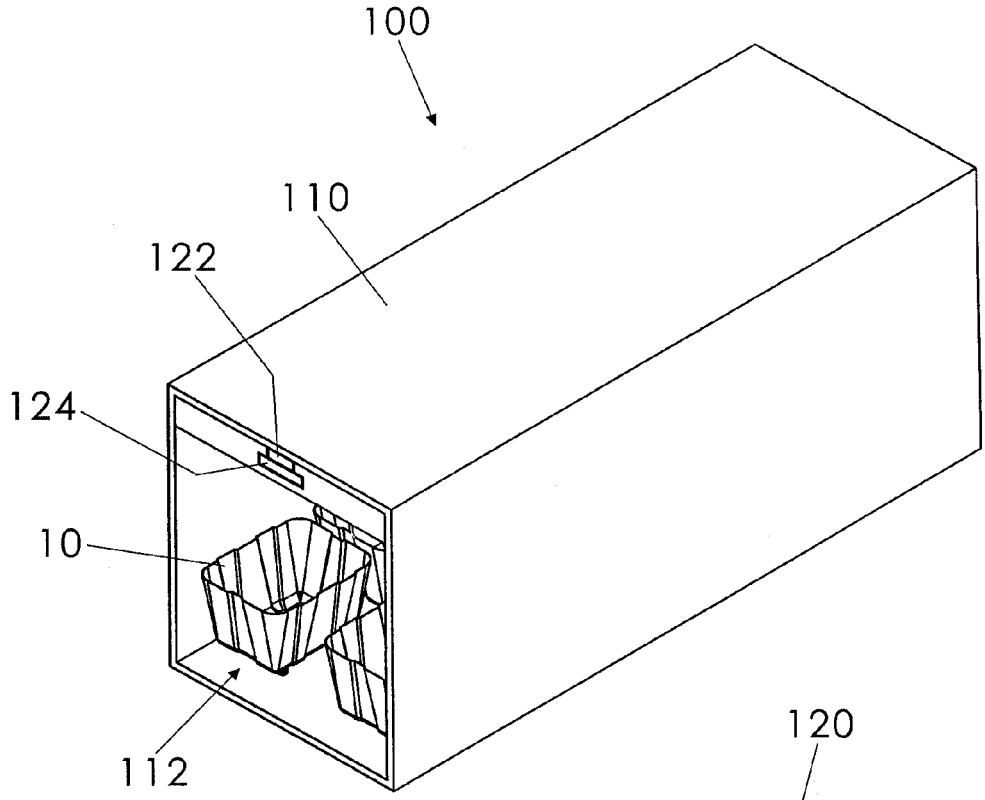
FIG. 1*a* is a perspective view of a laundry transport container according to a preferred embodiment of the present invention.

As shown in FIG. 1*a*, the container 110 defines an interior area 112 and has a door (not shown) for accessing the interior area 112. The door is movable between a closed configuration (not shown) and an open configuration (FIG. 1*a*) to selectively allow access to the interior area 112. The container 110 is configured to accommodate a plurality of laundry carts 10 in the interior area 112 (FIG. 1*a*). The container 110 may be a trailer configured to be moved by a vehicle (FIG. 1*a*) or may be otherwise mobile.

Figure 5:
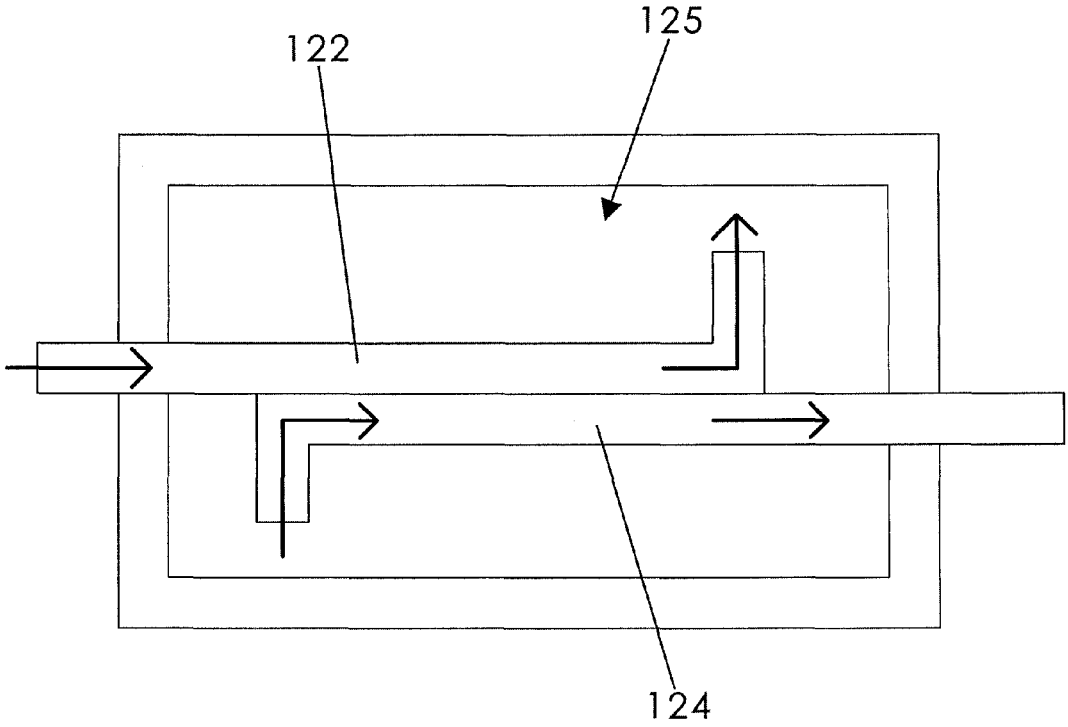
FIG. 5 is a schematic of a heat exchanger according to the present invention.

A ventilation network 120 is included to pass air to and from the interior area 112. The ventilation network 120 includes an intake duct 122 for channeling air to the interior area 112 and an outlet duct 124 for channeling air from the interior area 112. Apart from the ventilation network 120, the interior area 112 may be airtight when the door is at the closed configuration. One or more fan (not shown) may be configured (e.g., positioned and sized) to cause air to pass through the intake duct 122 and/or the outlet duct 124. To reduce or eliminate condensation, the intake and outlet ducts 122, 124 may form a heat exchanger 125. More particularly, at least a portion of the intake and outlet ducts 122, 124 are immediately adjacent one another to influence temperature of air passing through each duct 122, 124. Warmer air passing through one of the ducts 122, 124 becomes cooler from transferring energy to the cooler air passing through the other duct 122, 124, and the cooler air becomes warmer from obtaining the energy from the warmer air. FIG. 5 shows exemplary heat exchange between an intake duct 122 and an outlet duct 124.

Figure 3:
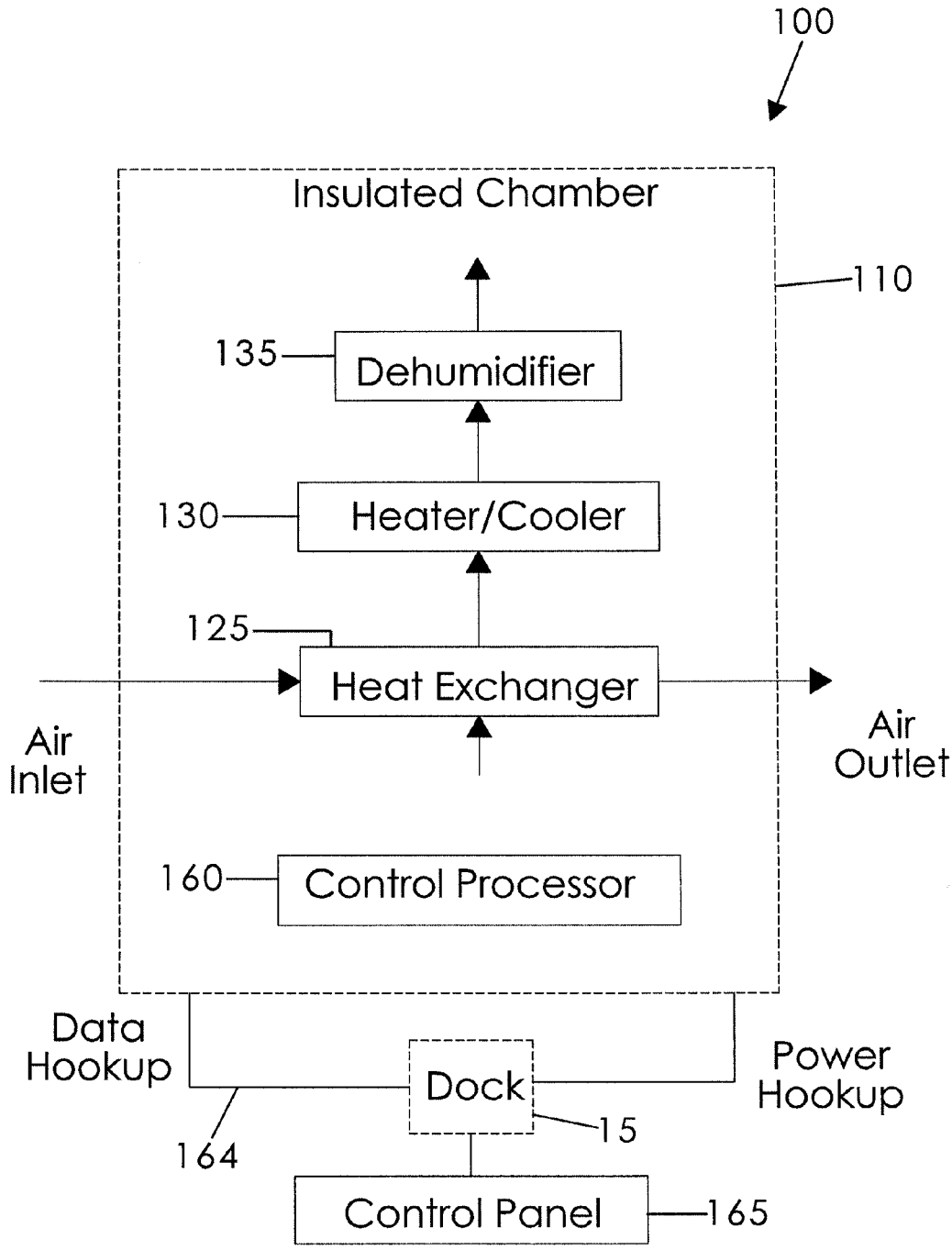
FIG. 3 is a block diagram of the laundry transport apparatus in engagement with a dock at a linen receiving area.
Figure 4:
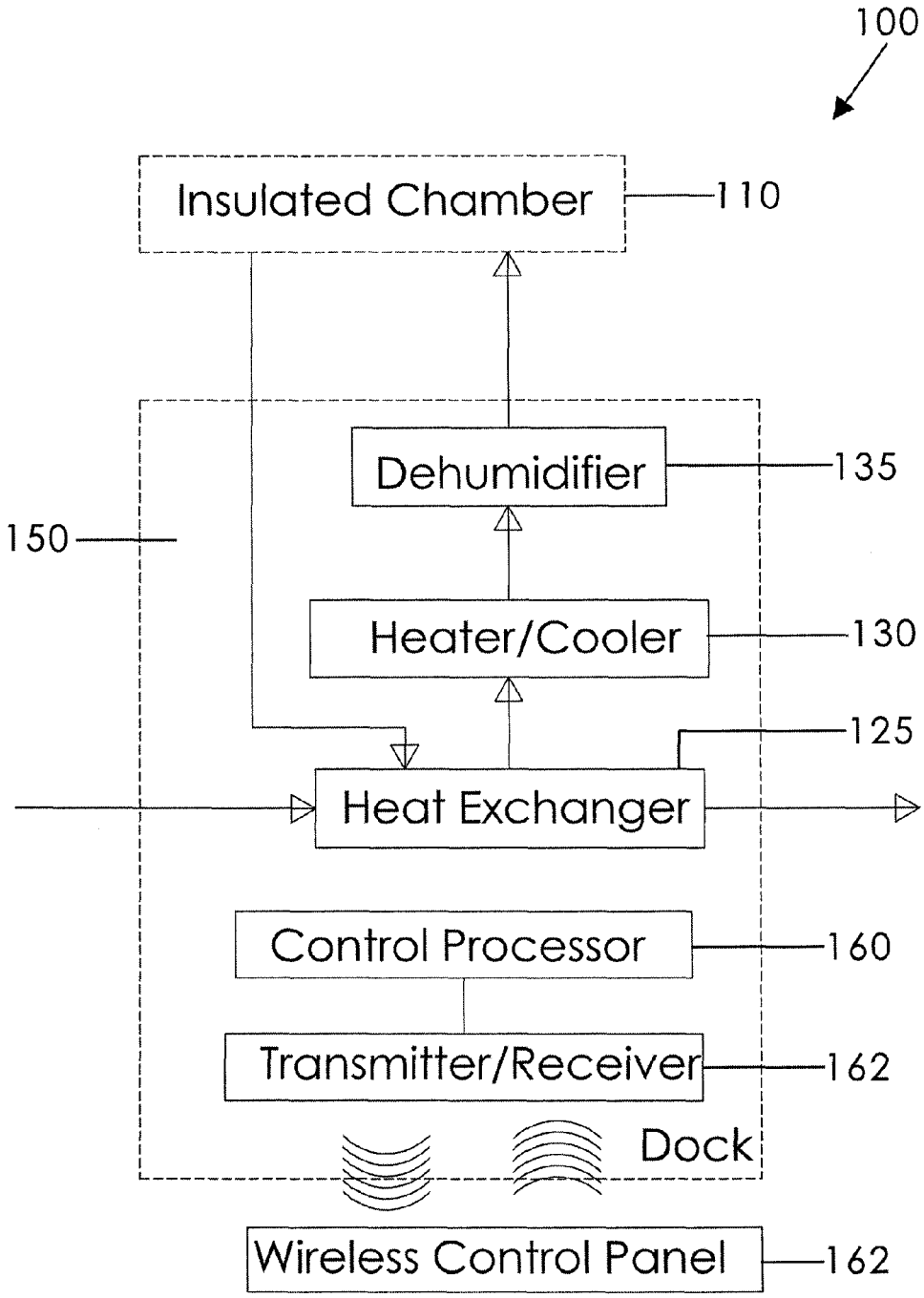
FIG. 4 is a block diagram of a laundry transport apparatus according to another embodiment of the present invention.

As shown in FIGS. 3 and 4, a climate controller 130 (e.g., a heater and air conditioner) may be included for selectively heating and cooling air passing through the intake duct 122 after the air is influenced by air passing through the outlet duct 124 to cause the air passing through the intake duct 122 to approximate a temperature of air in the interior area 112 separate from the ventilation network 120. Also shown in FIGS. 3 and 4, a dehumidifier 135 may be included for removing humidity from the air passing through the intake duct 122 (e.g., after passing through the heat exchanger 125 and the climate controller 130).

Figure 1B:
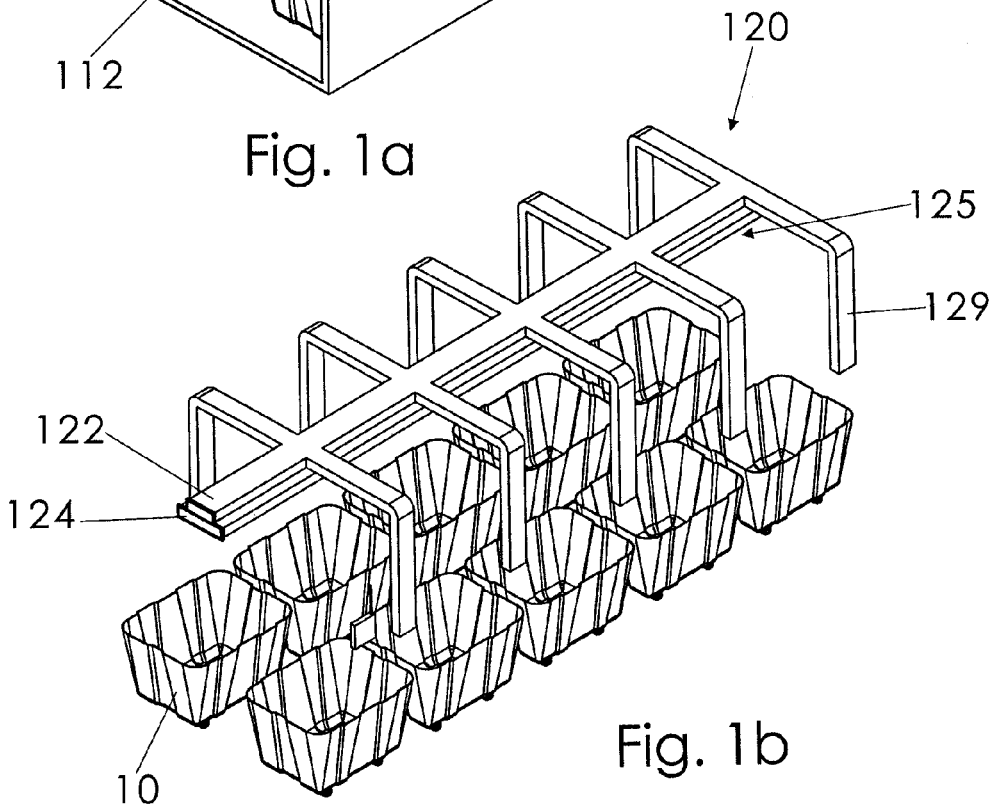
FIG. 1*b* is a perspective view of a ventilation network removed from the laundry transport container as in FIG. 1*a;*

In some embodiments, as shown in FIG. 1*b* and FIG. 3, the portions of the intake and outlet ducts 122, 124 immediately adjacent one another are operatively coupled to the container 110 (e.g., above where the carts 10 are accommodated, as shown in FIG. 1*b*). Branches 129 from the intake and/or outlet ducts 122, 124 may extend downwardly toward the carts 10 (FIG. 1*b*). The climate controller 130 and the dehumidifier 135 may also be operatively coupled to the container 110 (FIG. 3). In other embodiments, as shown in FIG. 4, a control unit 150 is separate from the container 110, and the portions of the intake and outlet ducts 122, 124 immediately adjacent one another are operatively coupled to the control unit 150. Similarly, the climate controller 130 and/or the dehumidifier 135 may be operative coupled to the control unit 150 (FIG. 4). If the control unit 150 is included, a portion of the ventilation network is coupled to the container 110 and another portion of the ventilation network is coupled to the control unit 150; these portions of the ventilation network are in selective communication with each other to allow air to pass to and from the interior area. When not in communication with each other, the portion of the ventilation network coupled to the container 110 may be sealed. For example, a removable cover or a flexible gasket may be used.

A processor 160 may be operatively coupled to the container 110 (FIG. 3) or the control unit 150 (FIG. 4) to store (e.g., using a memory device) and convey (e.g., through an output device) transport data, such as time data, temperature data, content data, etc. In conveying the transport data, a wireless data transfer system 162 (FIG. 4) or a wired data transfer system 164 to a control panel 165 at the dock 15 (FIG. 3) may be used.

In use, clean laundry is placed in the container 110 at a laundering facility and transported to its destination (e.g., a healthcare facility, etc.). The heat exchanger 125, climate controller 130, and dehumidifier 135 may maintain ventilation and acceptable humidity in the interior area 112 for the laundry during transport (FIG. 3) and after being left at a dock (FIG. 3 and FIG. 4). As such, the laundry may be transported further distances or simply housed in the container 110 for longer amounts of time than possible in prior art systems.

In many applications, the way laundry is transported is very important. Healthcare facilities, for example, may be required to comply with the Joint Commission on Accreditation of Healthcare Organizations and infectious control guidelines. As should be readily appreciated, transporting or storing clean laundry in a manner that does not protect the laundry from moisture, undesirable temperatures, insects, textile mold, or mildew is not acceptable. Prior art methods and systems often make multiple trips to a single facility during working (i.e., business) hours to maintain the clean nature of the laundry and to collect soiled laundry.

In most prior art situations, the end user collects laundry during working hours from various workstations. Soiled laundry is placed into linen carts that remain in specified locations throughout the facility. The soiled linen carts are picked up upon arrival of a laundry truck from a processing plant and weighed prior to loading onto the laundry truck. This process can be very inefficient and can lead to delays for both the cleaning staff and the launderers.

Figure 2:
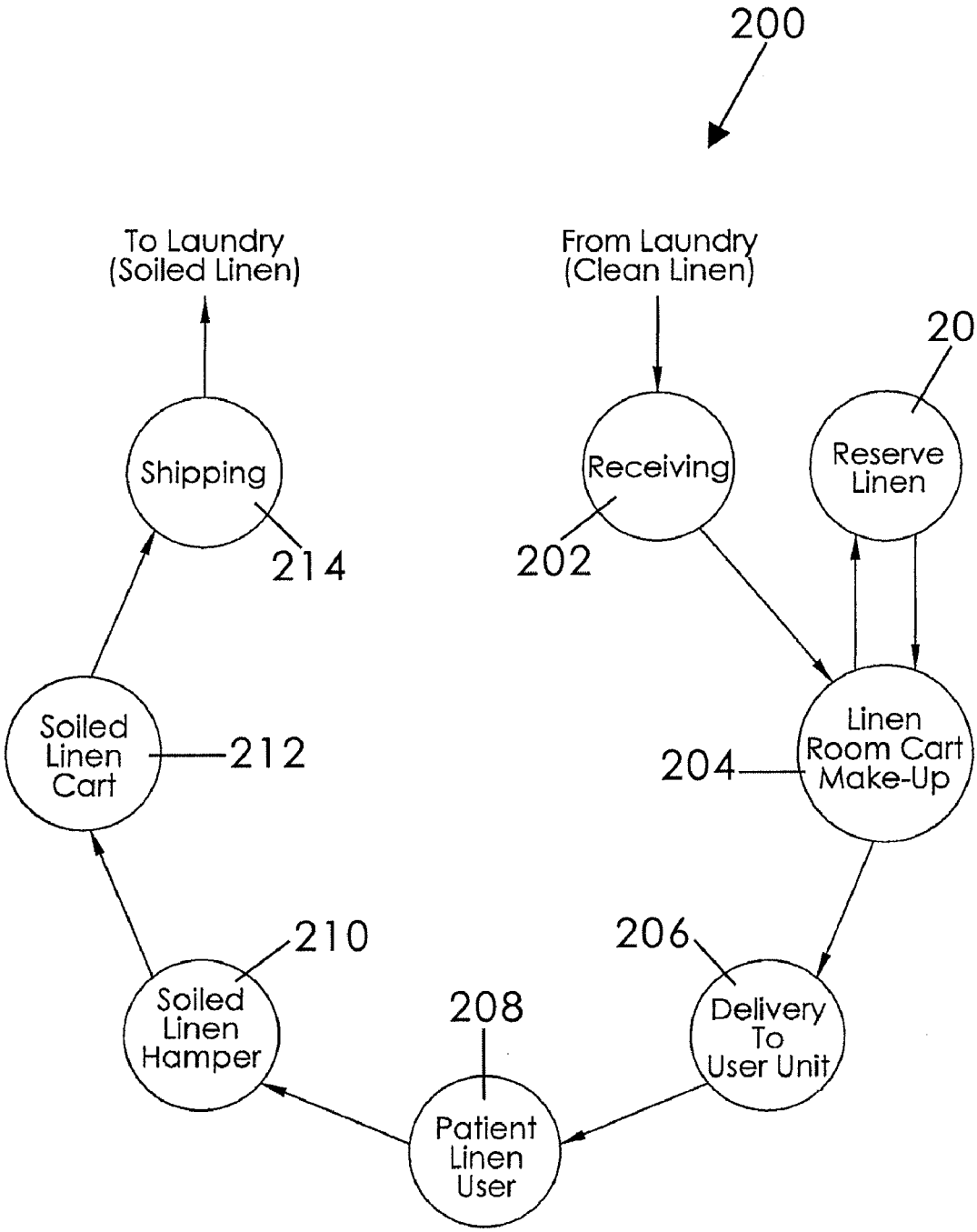
FIG. 2 is a flowchart illustrating a methodology for transporting and storage of laundry according to the present invention.

FIG. 2 shows an improved system 200 for laundry transportation and storage that utilizes the laundry transport apparatus 100. At step 202, the container 110 housing clean laundry in the interior area 112 is moved (e.g., by a truck) to a loading dock and left at the loading dock. If the control unit 150 is not used (FIG. 3), the container 110 may simply be left at the loading dock without further action, and the airflow and ventilation described above regarding FIG. 3 may occur; if the control unit 150 is used (FIG. 4), the container 110 may be placed in communication with the control unit 150 to allow airflow and ventilation described above regarding FIG. 4. While omitting the control unit 150 may provide a more simple docking process, utilizing a control unit 150 may provide a cost savings, as each individual container 110 does not have to include various elements (as discussed above regarding FIG. 4). Step 202 may occur during business hours or at night; the climate control provided inside the container 110 may allow the laundry to remain in the container 110 overnight without detriment. The processor 160 may be used to track the temperature in the container 110, humidity in the container 110, time the laundry was in the container 110, and/or any other information useful in determining whether the laundry has been compromised while in the container 110.

At step 204, the laundry is then moved into a linen (or "staging") room, where clean linen carts are configured using the laundry from the container 110 and laundry from a reserve linen area 20 if necessary. If not all laundry from the container 110 is needed for the carts, excess may be placed in the reserve linen area 20.

At step 206, the laundry in the clean linen carts is delivered to a unit for use, and the clean laundry is used at step 208. After being used, the laundry is placed in a soiled linen hamper at step 210, and laundry collected in the soiled linen hamper is moved to a linen cart at step 212. The soiled laundry from the soiled linen cart is collected, weighed, and moved to an empty container 110 at step 214 for transport to a laundering facility.

It is understood that while certain forms of this invention have been illustrated and described, it is not limited thereto except insofar as such limitations are included in the following claims and allowable functional equivalents thereof.

The invention claimed is:

1. A laundry transport apparatus, comprising:

a trailer having opposed front and rear ends, said container defining an opening at said front end and an interior area;

wherein said container includes a door at said container front end for selectively accessing said interior area, said door being movable between a closed configuration preventing access to said interior area and an open configuration giving access to said interior area;

a plurality of laundry carts removably positioned in said interior space, each laundry cart configured to hold laundry;

a ventilation network situated in said interior area and configured to pass air to and from said interior area, said ventilation network including:

an intake duct operatively coupled to a top wall of said trailer and extending longitudinally between said front and rear ends, said intake duct configured to channel air to said interior area;

an outlet duct immediately adjacent said intake duct and configured to channel air away from said interior area;

at least one fan configured to cause air to pass through said intake duct and said outlet duct;

wherein said interior area is airtight apart from said ventilation network when said door is at said closed configuration;

wherein intake and outlet ducts are immediately adjacent one another between said trailer front and rear ends to thereby form a heat exchange relationship so as to influence temperature of air passing through each said duct, warmer air passing through one of said intake duct or said outlet duct and thereby becoming cooler and cooler air passing through another of said intake duct or said outlet duct and thereby becoming warmer;

wherein said intake and outlet ducts include a plurality of branches extending outwardly and downwardly, each branch having a terminal end defining an opening positioned immediately adjacent a top of a respective laundry cart so as to ventilate said laundry in said respective laundry cart;

a climate controller for selectively heating and cooling air passing through said intake duct after said air is influenced by air passing through said outlet duct to cause said air passing through said intake duct to approximate a temperature of air in said interior area separate from said ventilation network; and a dehumidifier to selectively dehumidify air passing through said intake duct.

2. The laundry transport apparatus of claim 1, wherein:

said climate controller is operatively coupled to said container; and said dehumidifier is operatively coupled to said container.

3. The laundry transport apparatus of claim 1, further comprising a control unit separate from said container, and wherein:

a portion of said ventilation network is coupled to said container and another portion of said ventilation network is coupled to said control unit; and said portions of said ventilation network are in selective communication to allow air to pass to and from said interior area.

4. The laundry transport apparatus of claim 1, further comprising a processor operatively coupled to said container to store and convey transport data.

5. The laundry transport apparatus of claim 4, wherein transport data includes at least one of:

time data; and temperature data.

* * * * *